US010629168B2

(12) United States Patent
Lin et al.

(10) Patent No.: US 10,629,168 B2
(45) Date of Patent: Apr. 21, 2020

(54) DISPLAY CONTROL METHOD AND DISPLAY SYSTEM

(71) Applicant: Au Optronics Corporation, Hsinchu (TW)

(72) Inventors: Hui-Feng Lin, Taichung (TW); Sheng-Wen Cheng, Hsinchu (TW)

(73) Assignee: Au Optronics Corporation, Hsinchu (TW)

( * ) Notice: Subject to any disclaimer, the term of this patent is extended or adjusted under 35 U.S.C. 154(b) by 25 days.

(21) Appl. No.: 16/112,810

(22) Filed: Aug. 27, 2018

(65) Prior Publication Data

US 2019/0355330 A1 Nov. 21, 2019

(30) Foreign Application Priority Data

May 21, 2018 (TW) ..... 107117226 A

(51) Int. Cl.

| | |
|---|---|
| ***G09G 5/391*** | (2006.01) |
| ***G09G 3/20*** | (2006.01) |
| ***G09G 3/32*** | (2016.01) |
| ***G09G 3/34*** | (2006.01) |
| ***G09G 3/36*** | (2006.01) |

(52) U.S. Cl.

CPC ..... *G09G 5/391* (2013.01); *G09G 3/2003* (2013.01); *G09G 3/32* (2013.01); *G09G 3/3413* (2013.01); *G09G 3/3607* (2013.01); *G09G 2300/023* (2013.01); *G09G 2320/0626* (2013.01); *G09G 2340/0407* (2013.01)

(58) Field of Classification Search

None

See application file for complete search history.

(56) References Cited

U.S. PATENT DOCUMENTS

| | | | | |
|---|---|---|---|---|
| 7,911,442 | B2 | 3/2011 | Wang et al. | |
| 2017/0061896 | A1* | 3/2017 | Zhang | G09G 3/3426 |
| 2017/0167703 | A1 | 6/2017 | Cok | |

FOREIGN PATENT DOCUMENTS

| | | |
|---|---|---|
| CN | 1716045 | 1/2006 |
| CN | 1932615 | 3/2007 |
| CN | 201369152 | 12/2009 |
| CN | 103728773 | 4/2014 |
| TW | I401643 | 7/2013 |

* cited by examiner

*Primary Examiner* — Kenneth B Lee, Jr.

(74) *Attorney, Agent, or Firm* — JCIPRNET

(57) ABSTRACT

A display control method and a display system are provided. An image beam from a light-emitting display layer passes through a liquid crystal display layer to provide an image. The method includes: generating a plurality of second display signals respectively correspond to a plurality of subframes of a frame based on a first display signal, wherein the resolution of the second display signals is lower than that of the first display signal; performing brightness compensation on the first display signal to generate a third display signal; driving the light-emitting display layer according to the second display signals to emit the image beam in the corresponding subframe; and driving the liquid crystal display layer based on the third display signal such that a grayscale variation is generated to the image beam after the image beam passes through the liquid crystal display layer.

18 Claims, 8 Drawing Sheets

10

DISPLAY CONTROL METHOD AND DISPLAY SYSTEM

CROSS-REFERENCE TO RELATED APPLICATION

This application claims the priority benefit of Taiwan application serial no. 107117226, filed on May 21, 2018. The entirety of the above-mentioned patent application is hereby incorporated by reference herein and made a part of this specification.

BACKGROUND OF THE INVENTION

Field of the Invention

The invention relates to a display method, and more particularly, to a display control method and a display system of a micro LED display technique.

Description of Related Art

A display device with wide color gamut and high resolution can provide good viewing quality to a consumer, and therefore techniques developing a wide color gamut display device are of great interest. Although an active matrix organic light-emitting display (AMOLED) can increase color saturation, issues such as high material cost and low yield exist, and although the use of an AMOLED with subpixel rendering (SPR) to increase image resolution can reduce cost, image quality is affected. Liquid crystal panel techniques currently can achieve the object of wide color gamut display without the use of SPR. However, due to the use of a color filter (CF) or a multi-wavelength backlight module, power consumption is increased.

Therefore, how to provide a wide color gamut display device having high resolution under the conditions of reduced cost and low energy consumption is an important object for those skilled in the art.

SUMMARY OF THE INVENTION

Accordingly, the invention provides a display control method and a display system that can provide a wide color gamut display image having high transmittance, low energy consumption, and high resolution under the condition of reduced production costs in a multilayer display architecture.

An embodiment of the invention provides a display control method of a display system, wherein the display system includes a liquid crystal display layer and a light-emitting display layer, the light-emitting display layer emits an image beam, and the image beam passes through the liquid crystal display layer to provide an image. The display control method includes the following. A plurality of second display signals is generated according to a first display signal, wherein a resolution of the second display signals is lower than a resolution of the first display signal and the second display signals respectively correspond to a plurality of subframes, wherein the each frame includes the subframes. A brightness compensation is performed on the first display signal to generate a third display signal. The light-emitting display layer is driven according to the second display signals respectively in each of the frames to emit the image beam in the corresponding subframes. The liquid crystal display layer is driven according to the third display signal in simultaneously such that a grayscale variation is generated to the image beam after the image beam has passed through the liquid crystal display layer.

An embodiment of the invention provides a display system configured to receive a first display signal to provide an image, and the display system includes a light-emitting display layer, a liquid crystal display layer, a light-emitting display image processing circuit, a liquid crystal compensation processing circuit, a liquid crystal display driving circuit, and a light-emitting display driving circuit. The light-emitting display layer is configured to emit an image beam. The liquid crystal display layer is disposed on the light-emitting display layer along a transmission direction of the image beam, and the image beam passes through the liquid crystal display layer to provide an image. The light-emitting display image processing circuit is coupled to the light-emitting display layer and receives the first display signal and generates a plurality of second display signals based on the first display signal, wherein a resolution of the second display signals is lower than a resolution of the first display signal and the second display signals respectively correspond to a plurality of subframes, wherein each frame includes a plurality of the subframes. The liquid crystal compensation processing circuit is coupled to the liquid crystal display layer and the light-emitting display image processing circuit and receives the first display signal at the same time as the light-emitting display image processing circuit, wherein the liquid crystal compensation processing circuit performs a brightness compensation on the first display signal to generate a third display signal. The light-emitting display driving circuit is coupled to the light-emitting display image processing circuit and the light-emitting display layer and drives the light-emitting display layer according to the second display signals in each of the frames to emit the image beam in the corresponding subframes. The liquid crystal display driving circuit is coupled to the liquid crystal compensation processing circuit and the liquid crystal display layer and drives the liquid crystal display layer according to the third display signal in simultaneously in each of the frames such that a grayscale variation is generated to the image beam after the image beam has passed through the liquid crystal display layer.

Based on the above, in an embodiment of the invention, a high-resolution image is generated using the display system with a multilayer display panel architecture and via a display control method. The resolution of the light-emitting display layer on the bottom is lower, and the light-emitting display layer emits the image beam respectively in correspondence to the second display signals in a plurality of subframes within each frame to provide brightness and color. The display layer on top is a translucent liquid crystal display layer having higher resolution. In each of the frames, the liquid crystal display layer is driven according to the third display signal in simultaneously so as to cause the grayscale variation of the image beam after the image beam has passed through the liquid crystal display layer. Display details of the image beam can thus be modified and the overall image resolution can be increased. Therefore, a high-resolution display system that can expand color gamut and has high transmittance and low energy consumption can be provided under the condition of reduced production cost.

In order to make the aforementioned features and advantages of the disclosure more comprehensible, embodiments accompanied with figures are described in detail below.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
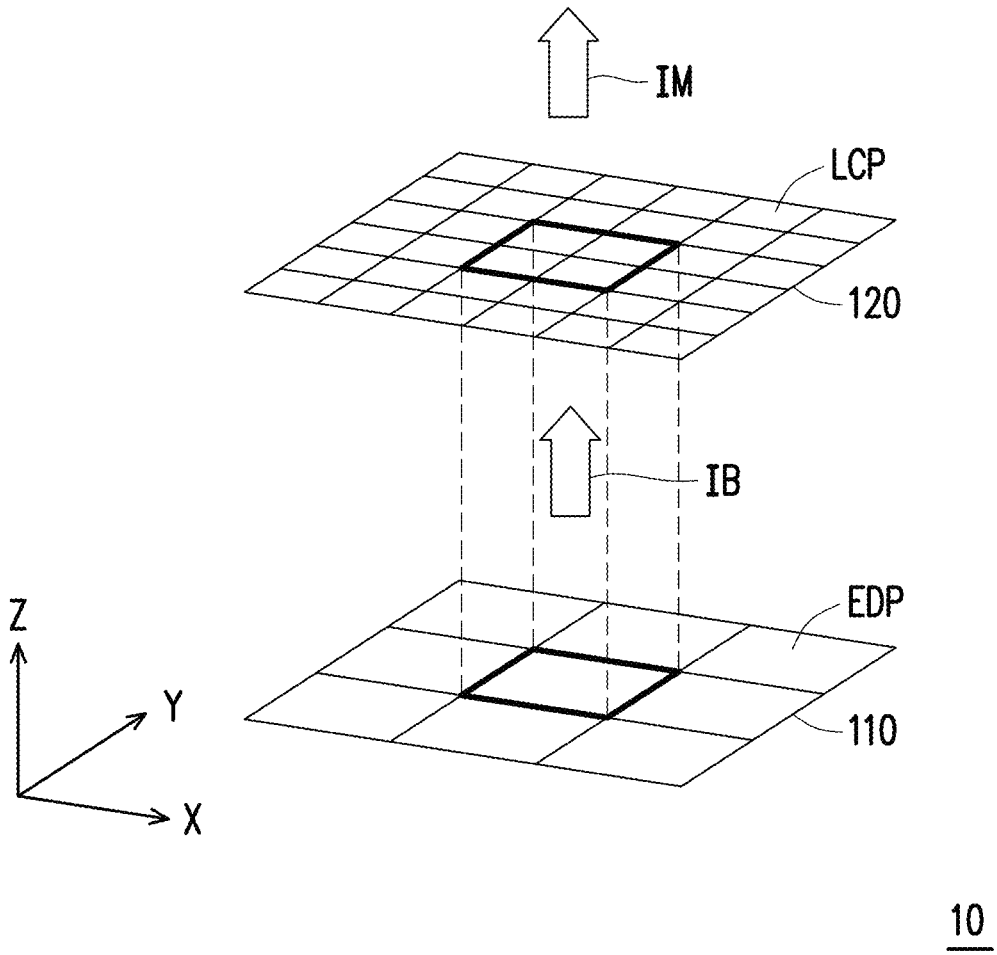
FIG. 1 is a block schematic of a display system of an embodiment of the invention.

In the following, a plurality of embodiments of the invention is disclosed via figures, and for clarity, many practical details are described together in the following. However, it should be understood that, the practical details should not be used to limit the invention. In other words, in some embodiments of the invention, the practical details are not necessary. Moreover, to simplify the figures, some known conventional structures and elements are shown in a simple schematic manner in the figures.

In the figures, for clarity, the thicknesses of, for instance, layers, films, panels, and regions are enlarged. In the entire specification, the same reference numerals represent the same elements. It should be understood that, when a layer, film, region, or an element of a substrate is "on" another element or "connected to" another element, the element can be directly on the other element or connected to the other element, or an intermediate element can be present between the elements. On the other hand, when an element is "directly on another element" or "directly connected to" another element, an intermediate element is not present. As used in the present specification, "connected to" can refer to a physical and/or electrical connection (coupling). Therefore, the electrical connection (or coupling) between two elements can include an intermediate element.

Figure 2:
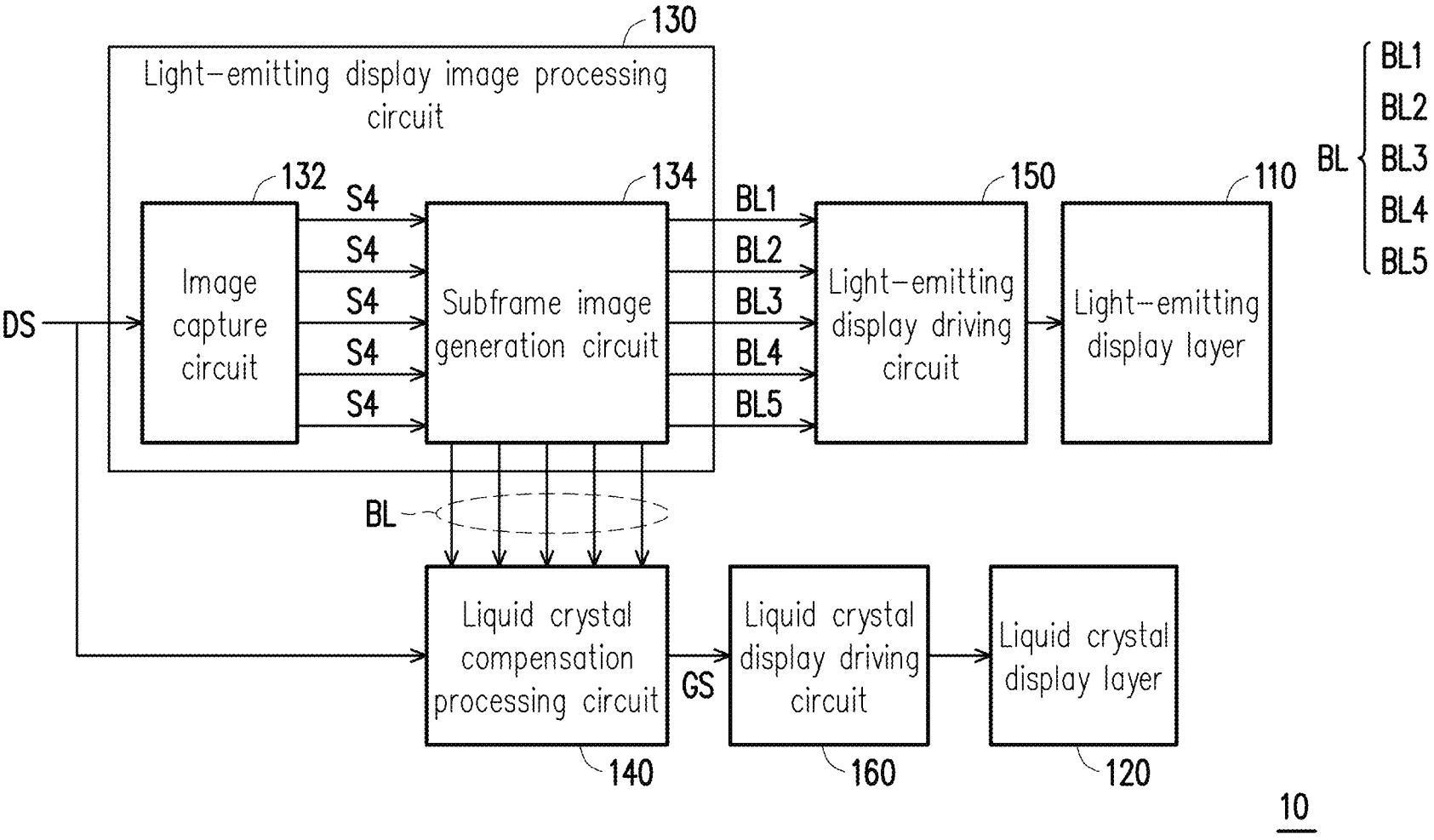
FIG. 2 is a circuit architecture schematic of the display system of the embodiment of FIG. 1 of the invention.

FIG. 1 is a block schematic of a display system of an embodiment of the invention. FIG. 2 is a circuit architecture schematic of the display system of the embodiment of FIG. 1 of the invention. Referring to both FIG. 1 and FIG. 2, a display system 10 includes a light-emitting display layer 110, a liquid crystal display layer 120, a light-emitting display image processing circuit 130, a liquid crystal compensation processing circuit 140, a light-emitting display driving circuit 150, and a liquid crystal display driving circuit 160.

In the present embodiment, the light-emitting display layer 110 is configured to emit an image beam IB. The liquid crystal display layer 120 is disposed on the light-emitting display layer 110 along a transmission direction of the image beam IB (i.e., the Z direction shown in FIG. 1), and the image beam IB passes through the liquid crystal display layer 120 to provide an image IM to be viewed by a user.

The light-emitting display image processing circuit 130 receives a first display signal DS and generates a plurality of second display signals BL based on the first display signal DS. The resolution of the second display signals BL can be lower than that of the first display signal DS.

The light-emitting display driving circuit 150 is coupled between the light-emitting display image processing circuit 130 and the light-emitting display layer 110, and the light-emitting display driving circuit 150 receives the second display signals BL from the light-emitting display image processing circuit 130. The light-emitting display driving circuit 150 can divide each frame into a plurality of subframes based on the quantity of the second display signals BL and drive the light-emitting display layer 110 according to the second display signals BL such that the light-emitting display layer 110 emits the image beam IB based on the corresponding second display signal BL in the subframes.

The liquid crystal compensation processing circuit 140 is coupled to the liquid crystal display layer 120 and the light-emitting display image processing circuit 130 and receives the first display signal DS at the same time as the light-emitting display image processing circuit 130. The liquid crystal compensation processing circuit 140 can perform a brightness compensation on the first display signal DS to generate a third display signal GS.

The liquid crystal display driving circuit 160 is coupled between the liquid crystal compensation processing circuit 140 and the liquid crystal display layer 120, and drives the liquid crystal display layer according to the third display signal GS in simultaneously in each frame so as to cause the grayscale variation of the image beam IB after the image beam IB has passed through the liquid crystal display layer 120.

Therefore, in the display system 10 of the present embodiment, the image beam IB provided by the light-emitting display layer 110 having a lower resolution on the bottom passes through the liquid crystal display layer 120 having a higher resolution on the top so as to cause the grayscale variation. Thus, the display system 10 achieves the efficacy of increasing the resolution of the displayed image. Hereinafter, specific embodiments of the display system 10 are described in detail with embodiments.

Specifically, the light-emitting display layer 110 is, for instance, a micro LED display having a plurality of pixels arranged in a matrix, and each of the pixels includes a plurality of LEDs respectively emitting beams of different colors, such as red, blue and green beams. In the invention, the quantity, color composition, and arrangement method . . . etc. of the LEDs in each of the pixels of the light-emitting display layer 110 are not limited. The light-emitting display layer 110 of the invention can be an element configured to display an image.

The liquid crystal display layer 120 can be a liquid crystal panel, and in the present embodiment, the liquid crystal display layer 120 is a colorless liquid crystal panel. After the image beam IB has passed through the liquid crystal display layer 120 and the chromaticity of the image beam IB is not changed. In another embodiment, the liquid crystal display layer 120 can be a monochrome liquid crystal panel, and the invention is not limited thereto. The resolution of the liquid crystal display layer 120 is higher than that of the light-emitting display layer 110. In an embodiment, the resolution of the liquid crystal display layer 120 is preferably 4 to 16 times that of the light-emitting display layer 110, and as shown in FIG. 1, one pixel EDP of the light-emitting display layer 110 can correspond to 4 pixels LCP of the liquid crystal display layer 120. In an embodiment, the resolution of the light-emitting display layer 110 is 960×540 pixels, and the resolution of the liquid crystal display layer 120 is 3840×2160 pixels. That is, if only the light-emitting display layer 110 is provided, then the image resolution can only reach the quality of high definition (HD), and if the light-emitting display layer 110 and the liquid crystal display layer 120 are provided, then the image resolution can reach the quality of full high definition (FHD) display, even ultra-high definition (UHD, 4K) display.

In the present embodiment, the light-emitting display image processing circuit 130 includes an image-capture circuit 132 and a subframe image generation circuit 134. The image-capture circuit 132 receives the first display signal DS, and the resolution of the first display signal DS here is, for instance, 3840×2160 pixels. The image-capture circuit 132 repeats the most marginal pixels of the image of the first display signal DS outward an even number of times to expand the resolution of the first display signal DS.

Figure 3:
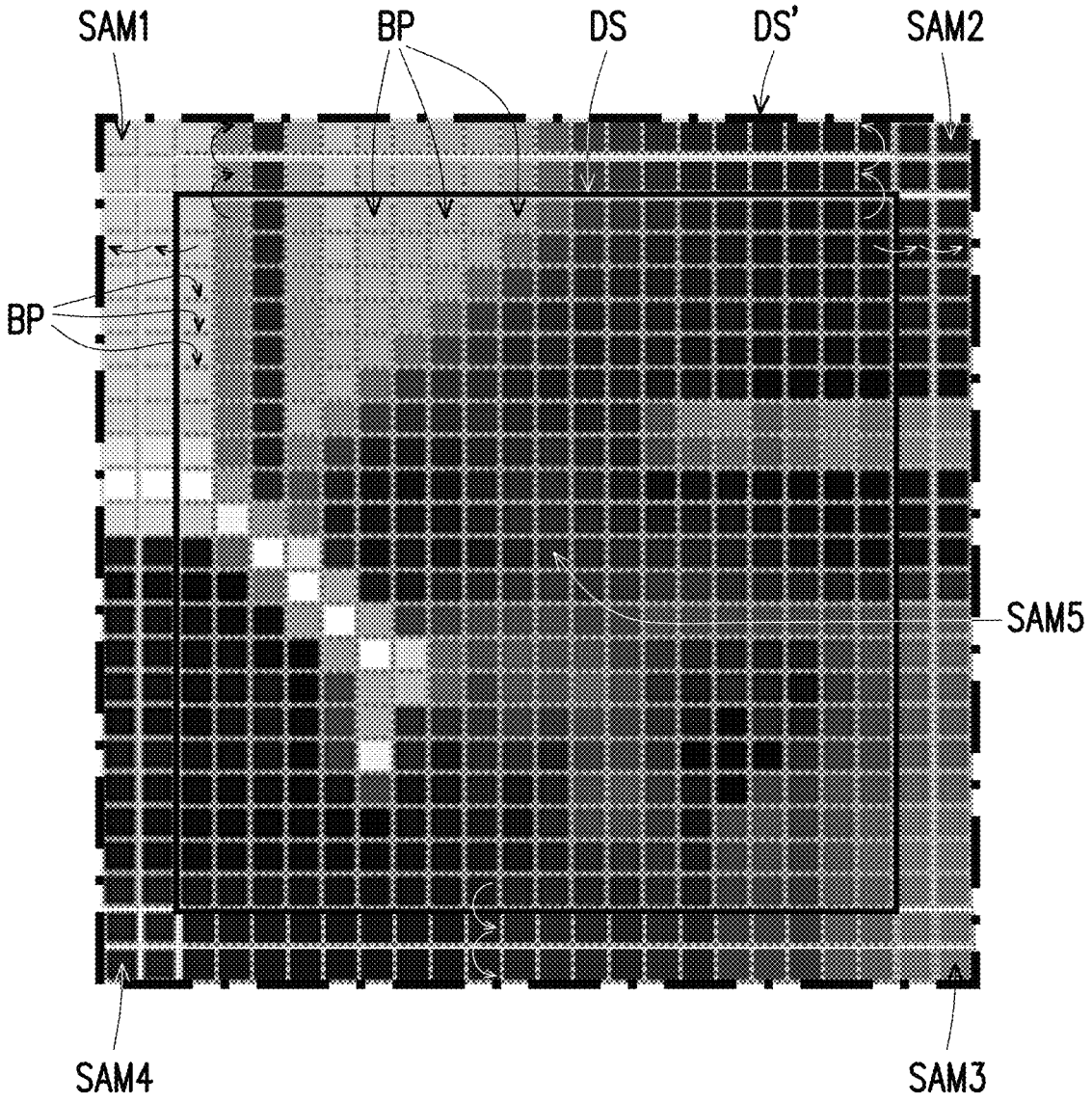
FIG. 3 is an expanded schematic of a first display signal of an embodiment of the invention.

FIG. 3 is an expanded schematic of a first display signal of an embodiment of the invention. Referring to FIG. 3, the most marginal pixels of the image of the first display signal DS are pixels BP, and, for instance, the most marginal pixels BP are respectively repeated outward an even number of times, and are repeated twice here as an example (but the invention is not limited thereto) to obtain an expanded first display signal DS'. For instance, the resolution of the first display signal DS is originally 3840×2160 pixels, and the resolution of the expanded first display signal DS' is 3844×2164 pixels.

The image-capture circuit 132 can capture a plurality of fourth display signals S4 from the expanded first display signal DS' respectively based on a plurality of sampling points, and the resolution of the fourth display signal S4 is the same as that of the first display signal DS. For instance, in the image of an expanded display signal S1', the most upper left pixel is used as a sampling point SAM1, the most upper right pixel is used as a sampling point SAM2, the most bottom right pixel is used as a sampling point SAM3, the most bottom left pixel is used as a sampling point SAM4, and the center point pixel of the original first display signal DS is used as a sampling point SAM5. For instance, the image-capture circuit 132 can use the sampling point SAM1 as a reference point (such as a boundary point) and capture the image toward the upper left from the expanded first display signal DS' as one of the fourth display signals S4, and the resolution thereof is 3840×2160 pixels (when the resolution of the first display signal DS is 3840×2160 pixels).

Figure 4:
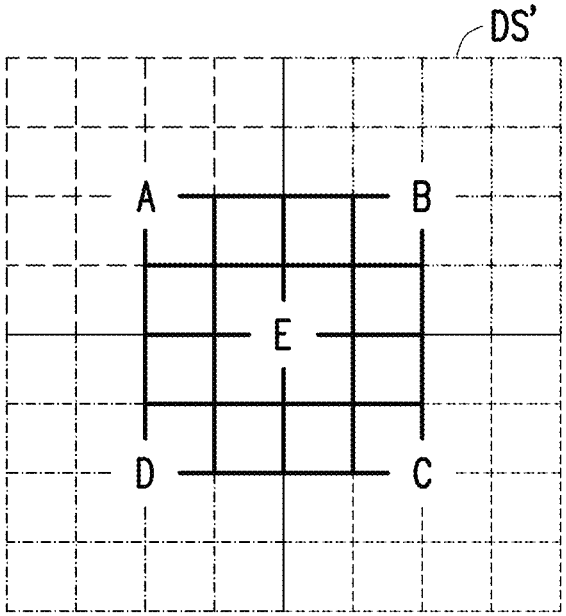
FIG. 4 is an image schematic of the capture of a fourth display signal from an expanded first display signal of an embodiment of the invention.

FIG. 4 is an image schematic of the capture of a fourth display signal from an expanded first display signal of an embodiment of the invention. Referring to FIG. 4 with FIG. 3, the image-capture circuit 132 can use the sampling point SAM1 as a reference point (such as a boundary point) and capture an image A toward the top left from the expanded first display signal DS' as one of the fourth display signals S4. Similarly, the image-capture circuit 132 captures an image B toward the upper right of the expanded first display signal DS' as one of the fourth display signals S4 with the sampling point SAM2 as a reference point, captures an image C toward the bottom right of the expanded first display signal DS' as one of the fourth display signals S4 with the sampling point SAM3 as a reference point, and captures an image D toward the bottom left of the expanded first display signal DS' as one of the fourth display signals S4 with the sampling point SAM4 as a reference point. However, it should be mentioned that, the sampling point SAM5 used as a reference point is used as a center point of the captured image, and a captured image E is the same as the original first display signal DS. That is, the fourth display signal S4 captured with the sampling point SAM5 as the reference point is the same as the original first display signal DS.

Figure 5:
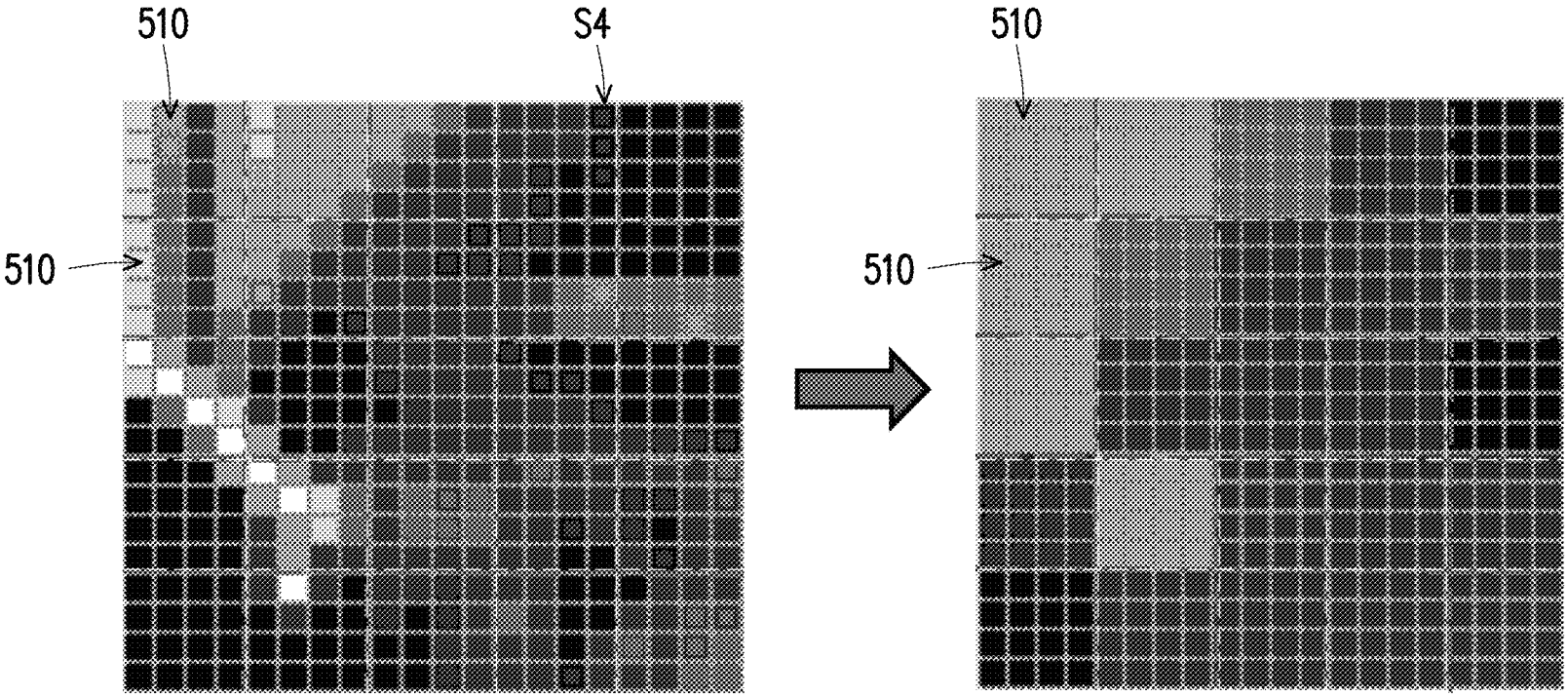
FIG. 5 is a schematic of the generation of a second display signal based on a fourth display signal of an embodiment of the invention.

FIG. 5 is a schematic of the generation of a second display signal based on a fourth display signal of an embodiment of the invention. Referring to FIG. 5, in the present embodiment, the subframe image generation circuit 134 is coupled to the image-capture circuit 132 to receive the fourth display signals S4 and divide the image of each of the received fourth display signals S4 into a plurality of pixel blocks 510, and the quantity of the pixel blocks 510 is equal to the resolution of the light-emitting display layer 110. Since the resolution of the first display signal DS is higher than the resolution of the light-emitting display layer 110, each of the pixel blocks 510 includes a plurality of pixels. For instance, the resolution of the first display signal DS is in a range higher than 4 to 16 times the resolution of the light-emitting display layer 110, and therefore the pixel quantity of each of the pixel blocks 510 is greater than or equal to 4 pixels and less than or equal to 16 pixels.

The subframe image generation circuit 134 calculates a color value corresponding to each of the pixel blocks 510 based on the color value of the pixels (R value, G value, and B value) for the image of each of the fourth display signals S4 and generates a plurality of second display signals BL based on the color values of the pixel blocks 510 in the fourth display signals S4. In the case of one of the fourth display signals S4, referring to Table 1 below, Table 1 shows the color value distribution of one of the pixel blocks 510. This pixel block 510 has 4×4 pixels, and Table 1 can be any one of the R value, G value, and B value.

TABLE 1

| | | | |
|---|---|---|---|
| 0.5 | 0.75 | 0.2 | 0 |
| 0.36 | 0.75 | 0.8 | 1 |
| 0.5 | 1 | 0.25 | 0.75 |
| 0.05 | 1 | 0.3 | 0.85 |

The subframe image generation circuit 134 can calculate the average value of the R value, G value, and B value of the brightness field in each of the pixel blocks 510. In the case of Table 1, the subframe image generation circuit 134 can calculate the average value of the brightness field of the pixel block 510 to be 0.57. Similarly, the subframe image generation circuit 134 can calculate the average value of the color values of all of the pixel blocks 510 of each of the fourth display signals S4 to generate a second display signal BL with reduced resolution. The average value of the brightness field obtained by the subframe image generation circuit 134 can be similar to the local dimming technique of a direct-type backlight driver of a known liquid crystal panel. In short, the subframe image generation circuit 134 generates a second display signal BL1 based on the fourth display signal S4 (refer to the image A of FIG. 4) corresponding to the sampling point SAM1, generates a second display signal BL2 based on the fourth display signal S4 (refer to the image B of FIG. 4) corresponding to the sampling point SAM2, generates a second display signal BL3 based on the fourth display signal S3 (refer to the image C of FIG. 4) corresponding to the sampling point SAM3, generates a second display signal BL4 based on the fourth display signal S4 (refer to the image D of FIG. 4) corresponding to the sampling point SAM4, and generates a second display signal BL5 based on the fourth display signal S4 (refer to the image E of FIG. 4) corresponding to the sampling point SAM5.

Figure 6:
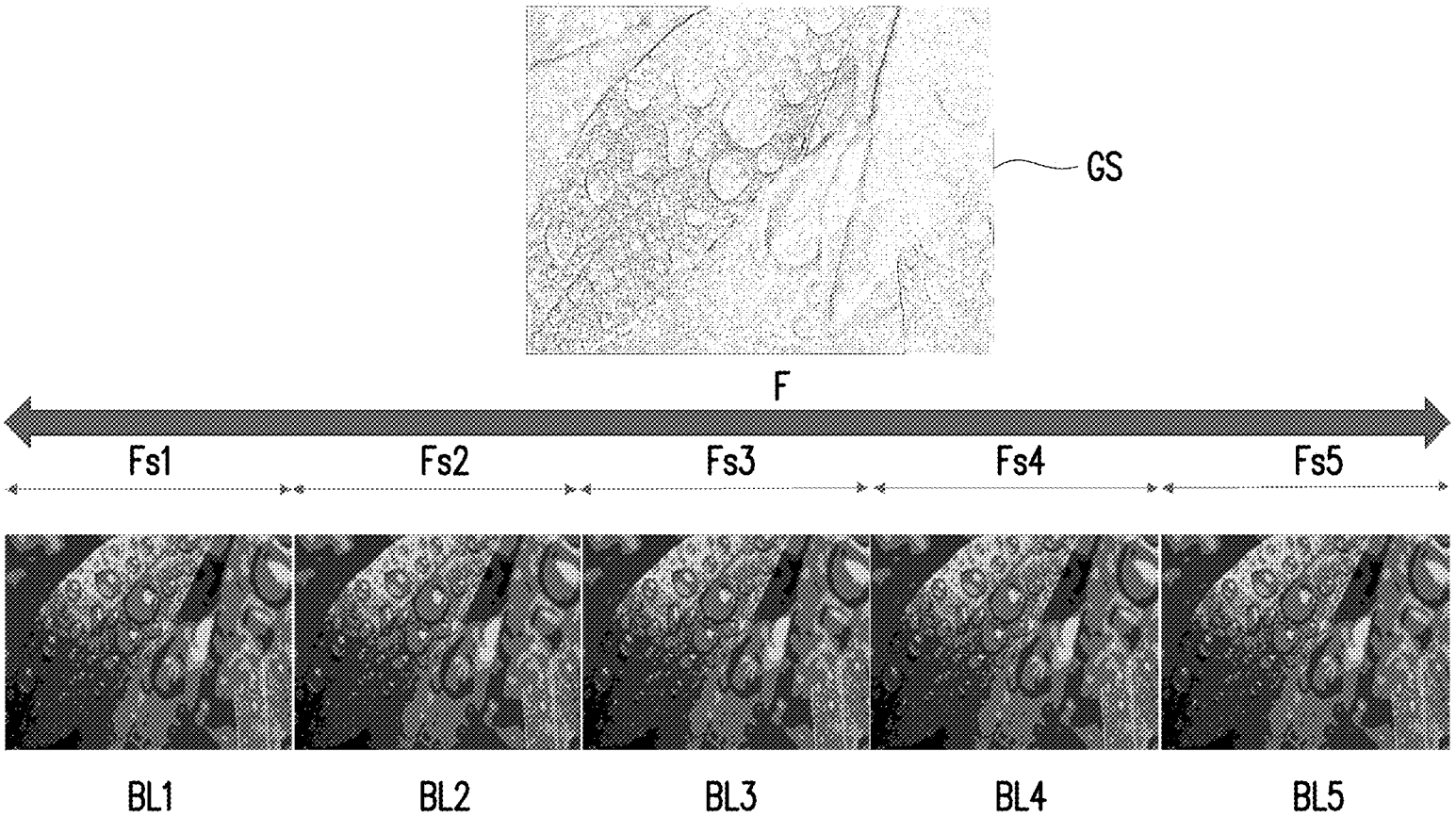
FIG. 6 is a process schematic of the driving of a light-emitting display layer via a light-emitting display driving circuit of an embodiment of the invention.

FIG. 6 is a process schematic of the driving of a light-emitting display layer 110 via a light-emitting display driving circuit 150 of an embodiment of the invention. Referring to FIG. 6, the light-emitting display driving circuit 150 receives a plurality of second display signals BL from the subframe image generation circuit 134, such as the second display signal BL1, the second display signal BL2, the second display signal BL3, the second display signal BL4, and the second display signal BL5, and drives the light emitting display layer 110 based on the second display signals BL to emit the image beam IB. The light-emitting display driving circuit 150 divides each of the frames F into a plurality of subframes Fs1, Fs2, Fs3, Fs4, and Fs5, and drives the light-emitting display layer 110 based on the second display signal BL1 within the subframe Fs1, drives the light-emitting display layer 110 based on the second display signal BL2 within the subframe Fs2, drives the light-emitting display layer 110 based on the second display signal BL3 within the subframe Fs3, drives the light-emitting display layer 110 based on the second display signal BL4 within the subframe Fs4, and drives the light-emitting display layer 110 based on the second display signal BL5 within the subframe Fs5. In other words, in one frame F, the light-emitting display layer 110 emits the image beam IB based on the second display signal BL corresponding to the order of the sampling point SAM1, the sampling point SAM2, the sampling point SAM3, the sampling point SAM4, and the sampling point SAM5.

It should be mentioned that, in the invention, the sampling locations of the sample points, the order of sampling, and the order in which the light-emitting display driving circuit 150 drives the light-emitting display layer 110 in correspondence to the sampling points are not limited, and those having ordinary skill in the art can make adjustments accordingly based on common knowledge and actual situation.

Moreover, in addition to receiving the first display signal DS at the same time as the light-emitting display image processing circuit 130, the liquid crystal compensation processing circuit 140 can also receive the second display signals BL from the subframe image generation circuit 134. The liquid crystal compensation processing circuit 140 can calculate the grayscale display signal based on the first display signal DS and calculate the grayscale compensation parameter based on the second display signals BL, and generate a third display signal GS based on the grayscale display signal and the grayscale compensation parameter.

Figure 7:
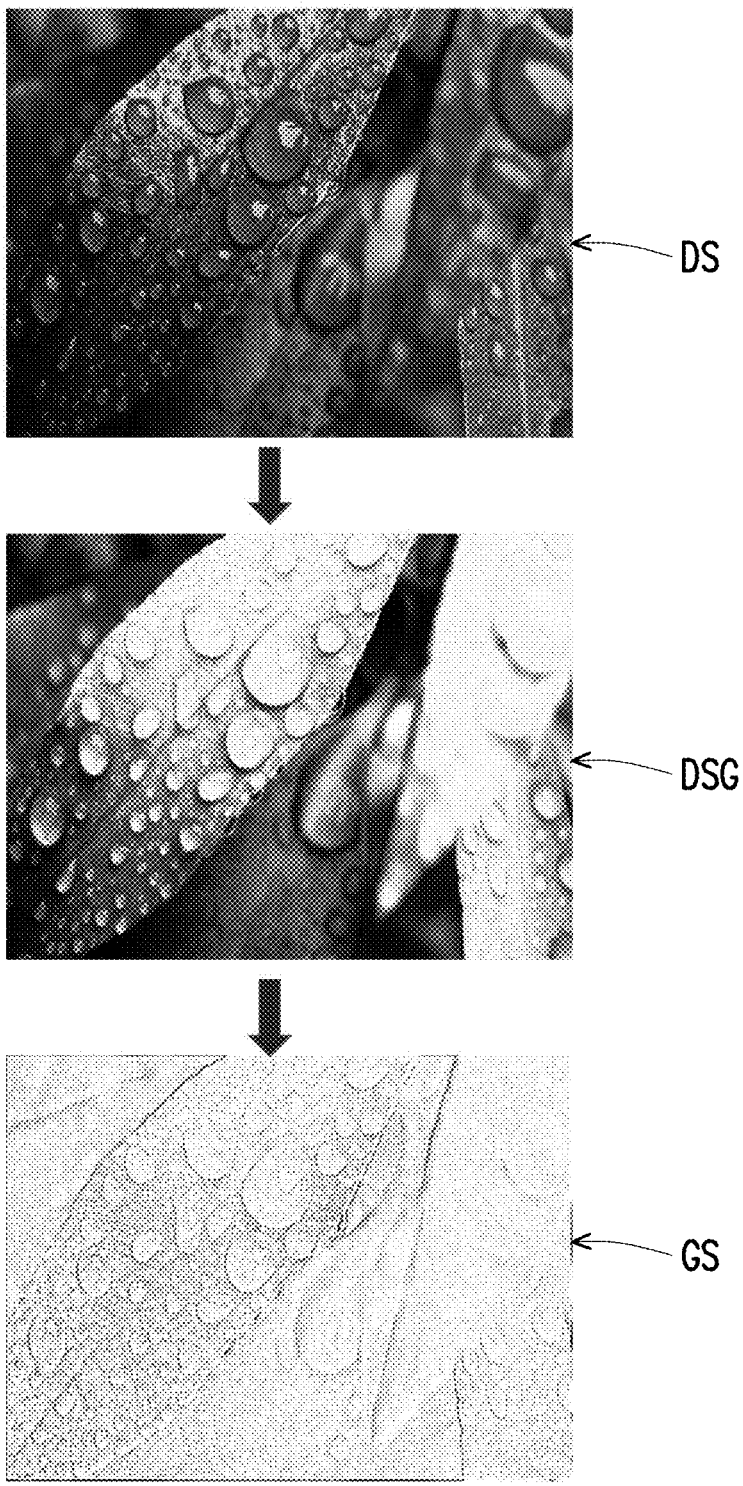
FIG. 7 is a process schematic of the generation of a third display signal via a liquid crystal compensation processing circuit of an embodiment of the invention.

FIG. 7 is a process schematic of the generation of a third display signal via a liquid crystal compensation processing circuit of an embodiment of the invention. Referring to FIG. 7, the first display signal DS can be a color image, and the liquid crystal compensation processing circuit 140 can analyze the first display signal DS to obtain a grayscale image DSG of the first display signal DS, i.e., the grayscale display signal above. Moreover, the liquid crystal compensation processing circuit 140 can further calculate an average value of color values corresponding to pixel blocks at the same location in the second display signals BL and use a reciprocal of a maximum average value corresponding to the pixel blocks as the grayscale compensation parameter. Referring to Table 2 below, Table 2 shows the color values of the second display signal BL of one pixel block.

TABLE 2

| | R value | G value | B value |
|---|---|---|---|
| BL1 | 1 | 0.75 | 1 |
| BL2 | 0.75 | 1 | 0.75 |
| BL3 | 1 | 1 | 1 |
| BL4 | 0.95 | 0.75 | 0.9 |
| BL5 | 0.75 | 1 | 0.95 |
| Total | 4.75 | 4.5 | 4.6 |
| Average value | 0.89 | 0.9 | 0.92 |
| Reciprocal of average value | 1.12 | 1.11 | 1.09 |

It can be known from Table 2 that, the reciprocal of the average value of the R value of the pixel block brightness field is 1.12, which is greater than the reciprocal 1.11 of the average value of the G value and the reciprocal 1.09 of the average value of the B value, and therefore the liquid crystal compensation processing circuit 140 adopts the reciprocal 1.12 of the largest average value as the grayscale compensation parameter of the pixel block. Similarly, the liquid crystal compensation processing circuit 140 can calculate the grayscale compensation parameter of each of the pixel blocks, and therefore each of the pixels has one corresponding grayscale compensation parameter.

The liquid crystal compensation processing circuit 140 multiples the grayscale display signal by the corresponding grayscale compensation parameter to generate the third display signal GS to achieve dynamic grayscale compensation.

Referring further to FIG. 6, the liquid crystal display driving circuit 160 receives the third display signal GS from the liquid crystal compensation processing circuit 140 and drives the liquid crystal display layer 120 based on the third display signal GS in each of the frames F such that a grayscale variation is generated to the image beam IB after the image beam IB passes through the liquid crystal display layer 110.

In other words, in one frame F, the light-emitting display driving circuit 150 drives the light-emitting display layer 110 based on the second display signals BL to display images in turns, such as displaying the second display signal BL1 in the subframe Fs1 and displaying the second display signal BL2 in the subframe Fs2, and the liquid crystal display driving circuit 160 drives the liquid crystal display layer 120 based on the third display signal GS to display a fixed grayscale image.

Figure 8:
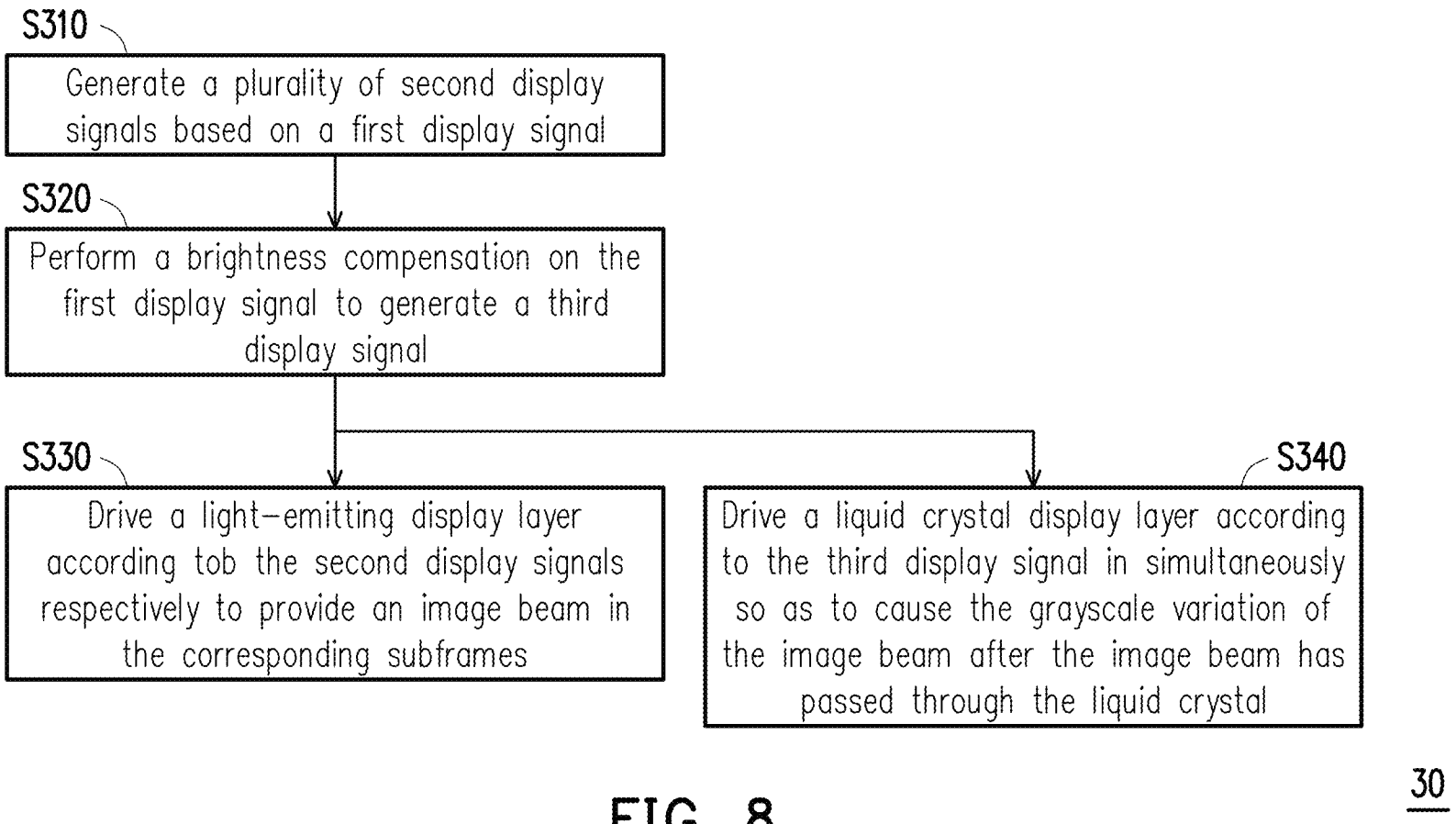
FIG. 8 is a flowchart diagram of a display control method of a display system of an embodiment of the invention.

FIG. 8 is a flowchart diagram of a display control method of a display system of an embodiment of the invention. Referring to FIG. 8, a display control method 30 is suitable for the display system 10 of FIG. 1 to FIG. 7, and in the following, the display control method 30 of the present embodiment is further described with each element in the display system 10.

In step S310, the light-emitting display image processing circuit 130 generates a plurality of second display signals BL based on the first display signal DS, wherein the resolution of the second display signals BL is lower than that of the first display signal DS and the second display signals BL respectively correspond to a plurality of subframes, wherein each frame includes the subframes. For instance, the frame F includes 5 subframes Fs1, Fs2, Fs3, Fs4, and Fs5, and then in step S320, the light-emitting display image processing circuit 130 performs a brightness compensation on the first display signal DS to generate the third display signal GS, and then steps S330 and S340 are performed at the same time. In step S330, in each frame, the light-emitting display driving circuit 150 drives the light-emitting display layer 110 according to the second display signals respectively BL to emit the image beam IB in the corresponding subframe, and in step S340, the liquid crystal display driving circuit 160 drives the liquid crystal display layer 120 based on the third display signal GD such that a grayscale variation is generated to the image beam IB after the image beam IB passes through the liquid crystal display layer 120. The omitted portions are described in the previous embodiments and are not repeated in the following embodiments.

Based on the above, the display system and display control method of an embodiment of the invention provide a display architecture having a light-emitting display layer and a liquid crystal display layer overlapped in a vertical manner, and the light-emitting display layer on the bottom has a lower resolution and the liquid crystal display layer on the top has a higher resolution to provide a grayscale image. The display system can receive the first display signal having the same resolution as the liquid crystal display layer and generate a plurality of second display signals having the same resolution as the light-emitting display layer, and in one frame, the light-emitting display layer displays a plurality of second display signals in turns and emits different image beams so as to display a color image. The liquid crystal display layer displays a grayscale image of the first display signal after grayscale compensation, and when the image beam passes through the liquid crystal display layer, the grayscale variation of the image beam can be adjusted to increase the quality and resolution of the display device. Therefore, the display system and display control method of the invention do not require the use of a color filter and can avoid the issue of reduced transmittance. Moreover, in the invention, a micro LED display module is used as a self-luminous display dot pixel to achieve the efficacy of reduced energy consumption and increased gamut breadth.

Although the invention has been described with reference to the above embodiments, it will be apparent to one of ordinary skill in the art that modifications to the described embodiments may be made without departing from the spirit of the invention. Accordingly, the scope of the invention is defined by the attached claims not by the above detailed descriptions.

What is claimed is:

1. A display control method of a display system, wherein the display system comprises a liquid crystal display layer and a light-emitting display layer, the light-emitting display layer emits an image beam, the image beam passes through the liquid crystal display layer to provide an image, and the display control method comprises:

generating a plurality of second display signals based on a first display signal, wherein a resolution of the second display signals is lower than the resolution of the first display signal and the second display signals respectively correspond to a plurality of subframes, wherein each frame comprises the subframes, wherein the step of generating the second display signals based on the first display signal comprises:

expanding the resolution of the first display signal;

capturing a plurality of fourth display signals from the expanded first display signal respectively based on a plurality of sampling points, wherein the resolution of the fourth display signals is the same as the resolution of the first display signal;

dividing the image of each of the fourth display signals into a plurality of pixel blocks, wherein each of the pixel blocks comprises a plurality of pixels, and a quantity of the pixel blocks is equal to a resolution of the light-emitting display layer;

calculating a color value corresponding to each of the pixel blocks based on color values of the pixels for the image of each of the fourth display signals; and generating the second display signals based on the color values corresponding to the pixel blocks in the fourth display signals;

performing a brightness compensation on the first display signal to generate a third display signal;

driving the light-emitting display layer according to the second display signals respectively to emit the image beam in the corresponding subframes in each of the frames; and driving the liquid crystal display layer according to the third display signal in simultaneously.

2. The display control method of claim 1, wherein a pixel quantity of each of the pixel blocks is greater than or equal to 4 pixels and less than or equal to 16 pixels.

3. The display control method of claim 1, wherein the step of expanding the resolution of the first display signal comprises:

repeating the most marginal pixels of the image of the first display signal outward an even number of times to expand the resolution of the first display signal.

4. The display control method of claim 1, wherein the sampling points comprise a most upper left pixel, a most upper right pixel, a most bottom right pixel, and a most bottom left pixel of the image of the expanded display signal and a center point pixel of the original first display signal, and in one of the frames, the light-emitting display layer emits the image beam based on the second display signals in an order corresponding to the most upper left pixel, the most upper right pixel, the most bottom right pixel, the most bottom left pixel, and the center point pixel.

5. The display control method of claim 1, wherein the step of performing the brightness compensation on the first display signal to generate the third display signal comprises:

calculating a grayscale display signal based on the first display signal;

calculating a grayscale compensation parameter based on the second display signals; and generating the third display signal based on the grayscale display signal and the grayscale compensation parameter.

6. The display control method of claim 5, wherein the step of calculating the grayscale compensation parameter based on the second display signals comprises:

calculating an average value of color values corresponding to pixel blocks at a same location in the second display signals and using a reciprocal of a maximum average value corresponding to the pixel blocks as the grayscale compensation parameter.

7. The display control method of claim 1, wherein the light-emitting display layer is a light-emitting diode backlight module, the light-emitting display layer is a plurality of pixels arranged in a matrix, and each of the pixels comprises a plurality of light-emitting diodes respectively configured to emit red, blue, and green beams.

8. The display control method of claim 1, wherein the resolution of the liquid crystal display layer is higher than the resolution of the light-emitting display layer.

9. The display control method of claim 1, wherein after the image beam has passed through the liquid crystal display layer, a chromaticity thereof is not changed.

10. A display system configured to receive a first display signal to provide an image, comprising:

a light-emitting display layer configured to emit an image beam;

a liquid crystal display layer disposed on the light-emitting display layer along a transmission direction of the image beam, and the image beam passes through the liquid crystal display layer to provide the image;

a light-emitting display image processing circuit coupled to the light-emitting display layer and receiving the first display signal and generating a plurality of second display signals based on the first display signal, wherein a resolution of the second display signals is less than the resolution of the first display signal and the second display signals respectively correspond to a plurality of subframes, wherein each frame comprises the subframes, wherein the light-emitting display image processing circuit comprises:

an image-capture circuit configured to receive the first display signal, wherein the image-capture circuit expands the resolution of the first display signal and captures a plurality of fourth display signals from the expanded first display signal respectively based on a plurality of sampling points, wherein the resolution of the fourth display signals is the same as the resolution of the first display signal; and a subframe image generation circuit coupled to the image-capture circuit and dividing the image of each of the received fourth display signals into a plurality of pixel blocks, wherein each of the pixel blocks comprises a plurality of pixels, a quantity of the pixel blocks is equal to the resolution of the light-emitting display layer, and the subframe image generation circuit calculates a color value corresponding to each of the pixel blocks based on color values of the pixels for the image of each of the fourth display signals and generates the second display signals based on the color value corresponding to the pixel blocks in the fourth display signals;

a liquid crystal compensation processing circuit coupled to the liquid crystal display layer and the light-emitting display image processing circuit and receiving the first display signal at the same time as the light-emitting display image processing circuit, wherein the liquid crystal compensation processing circuit performs a brightness compensation on the first display signal to generate a third display signal;

a light-emitting display driving circuit coupled between the light-emitting display image processing circuit and the light-emitting display layer and driving the light-emitting display layer according to the second display signals in each of the frames to emit the image beam in the corresponding subframes; and a liquid crystal display driving circuit coupled between the liquid crystal compensation processing circuit and the liquid crystal display layer and driving the liquid crystal display layer according to the third display signal in simultaneously in each of the frames.

11. The display system of claim 10, wherein a pixel quantity of each of the pixel blocks is greater than or equal to 4 pixels and less than or equal to 16 pixels.

12. The display system of claim 10, wherein the image-capture circuit repeats the most marginal pixels of the image of the first display signal outward an even number of times to expand the resolution of the first display signal.

13. The display system of claim 10, wherein the sampling points comprise a most upper left pixel, a most upper right pixel, a most bottom right pixel, and a most bottom left pixel of the image of the expanded display signal and a center point pixel of the original first display signal, and in one of the frames, the light-emitting display layer emits the image beam based on the second display signals in an order corresponding to the most upper left pixel, the most upper right pixel, the most bottom right pixel, the most bottom left pixel, and the center point pixel.

14. The display system of claim 10, wherein the liquid crystal compensation processing circuit is coupled to the subframe image generation circuit and receives the second display signals from the subframe image generation circuit, and the liquid crystal compensation processing circuit calculates a grayscale display signal based on the first display signal, calculates a grayscale compensation parameter based on the second display signals, and generates the third display signal based on the grayscale display signal and the grayscale compensation parameter.

15. The display system of claim 14, wherein the liquid crystal compensation processing circuit calculates an average value of color values corresponding to pixel blocks at a same location in the second display signals and uses a reciprocal of a maximum average value corresponding to the pixel blocks as the grayscale compensation parameter.

16. The display system of claim 10, wherein the light-emitting display layer is a light-emitting diode backlight module, the light-emitting display layer is a plurality of pixels arranged in a matrix, and each of the pixels comprises a plurality of light-emitting diodes respectively configured to emit red, blue, and green beams.

17. The display system of claim 10, wherein the resolution of the liquid crystal display layer is higher than the resolution of the light-emitting display layer.

18. The display system of claim 10, wherein after the image beam has passed through the liquid crystal display layer, a chromaticity thereof is not changed.

* * * * *